US009734959B2

(12) United States Patent
Cho

(10) Patent No.: US 9,734,959 B2
(45) Date of Patent: Aug. 15, 2017

(54) STRUCTURE OF CROSSBAR FOR MANUAL MOTOR STARTER

(71) Applicant: LSIS CO., LTD., Anyang-si, Gyeonggi-do (KR)

(72) Inventor: Hyungeun Cho, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/975,459

(22) Filed: Dec. 18, 2015

(65) Prior Publication Data

US 2016/0217940 A1 Jul. 28, 2016

(30) Foreign Application Priority Data

Jan. 22, 2015 (KR) ..... 10-2015-0010790

(51) Int. Cl.

| | |
|---|---|
| ***H01H 25/00*** | (2006.01) |
| ***H01H 3/02*** | (2006.01) |
| ***H01H 71/46*** | (2006.01) |
| ***H01H 83/00*** | (2006.01) |
| *H01H 71/56* | (2006.01) |

(52) U.S. Cl.

CPC ..... *H01H 3/02* (2013.01); *H01H 71/46* (2013.01); *H01H 83/00* (2013.01); *H01H 71/56* (2013.01)

(58) Field of Classification Search

CPC ..... H01H 3/02; H01H 71/46; H01H 83/00; H01H 71/10; H01H 71/1009; H01H 71/1054; H01H 71/12; H01H 71/04; H01H 71/50; H01H 71/52; H01H 73/02; H01H 73/26; H01H 73/48; H01H 9/00; H01H 9/26; H01H 3/00; H01H 71/56

USPC ... 200/337, 19.27, 51 R, 439, 520, 321, 341

See application file for complete search history.

(56) References Cited

U.S. PATENT DOCUMENTS

| | | | | |
|---|---|---|---|---|
| 4,831,221 A | | 5/1989 | Yu et al. | |
| 5,697,494 A | * | 12/1997 | Christy | H01H 1/16 200/277.1 |
| 6,232,855 B1 | | 5/2001 | Malingowski et al. | |
| 7,023,303 B1 | | 4/2006 | Bogdon et al. | |
| 2004/0257180 A1 | | 12/2004 | Fischer | |

OTHER PUBLICATIONS

European Patent Office Application No. 15202416.2, Search Report dated Jun. 30, 2016, 9 pages.

* cited by examiner

*Primary Examiner* — Anthony R. Jimenez
(74) *Attorney, Agent, or Firm* — Lee, Hong, Degerman, Kang & Waimey

(57) ABSTRACT

The present disclosure relates to a structure of a crossbar for a manual motor starter, and particularly, to a structure of a crossbar for a manual motor starter in which a function of an auxiliary lever is performed by a crossbar to thus reduce the number of components and an operational error. The structure of a crossbar for a manual motor starter (MMS) including a crossbar connected to an operating mechanism and an auxiliary contact lever operating an auxiliary contact, wherein a pressing unit is formed in the crossbar to operate the auxiliary contact lever upwardly.

5 Claims, 8 Drawing Sheets

STRUCTURE OF CROSSBAR FOR MANUAL MOTOR STARTER

CROSS-REFERENCE TO RELATED APPLICATION

Pursuant to 35 U.S.C. §119(a), this application claims the benefit of earlier filing date and right of priority to Korean Patent Application No. 10-2015-0010790, filed on Jan. 22, 2015, the contents of which are hereby incorporated by reference herein in its entirety.

BACKGROUND OF THE INVENTION

1. Field of the Invention

The present disclosure relates to a structure of a crossbar for a manual motor starter, and particularly, to a structure of a crossbar for a manual motor starter in which a function of an auxiliary lever is performed by a crossbar to thus reduce the number of components and an operational error.

2. Background of the Invention

In general, a manual motor starter (MMS), a device used in an electric line in which a rated insulation voltage is alternating current (AC) 690V (frequency 50 Hz or 60 Hz), is installed in a front stage of a motor to operate in the event of an fault current such as an overcurrent, phase loss, phase reverse, a short circuit, and a ground fault to break a system in order to protect the system and a load device.

The MMS includes a detecting unit for detecting a fault current such as an overcurrent, phase loss, phase reverse, a short circuit, and a ground fault in the occurrence thereof, an operating mechanism for tripping a circuit breaker according to a detection signal from the detecting unit, a contact unit cooperatively operated according to an operation of the operating mechanism to open and close an electric line, and an arc extinguishing unit extinguishing an arc generated as contacts of the contact unit are separated and discharging the same to the outside. Also, an auxiliary contact unit for sending a control signal to an accessory device according to an operation of the operating mechanism is also provided.

In the MMR, during normal conduction, a movable contact and a fixed contact of the contact unit are connected and a current flowing into a power source side terminal is allowed to flow to a load side terminal, but when a fault current occurs, the detecting unit detects the fault current and drives the operating mechanism, the movable contact of the movable contact arm is separated from a fixed contact of a fixed contact arm to cut off the current flowing to the load side.

FIG. 1 is a perspective view of an MMS according to the related art, and FIG. 2 is a vertical cross-sectional view illustrating an operational state of the MMR according to the related art in which a handle is in an ON state, viewed in a lateral direction.

The MMR according to the related art includes a crossbar 1, an auxiliary lever 2, a mechanism assembly 3, an auxiliary contact lever 4, and handle 6.

The MMR according to the related art operates as follows.

When the handle 6 is in an OFF state, the crossbar 1 is lowered by the mechanism assembly 3, and a connection member 7 connected thereto presses the movable contact arm 9 downwardly, and thus, the movable contact arm 9 is separated from the fixed contact arm 8 and a current does not flow in the circuit. Also, when the crossbar 1 is lowered, the auxiliary lever 2 is also in a lowered position, and thus, the auxiliary lever 2 cannot operate the auxiliary contact lever 4 and the auxiliary contact 5 is in a separated state.

When the handle 6 is rotated from the OFF position to an ON position, the mechanism assembly 3 operates and the crossbar 1 is released from a pressed state and moves up. Accordingly, the movable contact arm 9 of the contact unit is lifted to come into contact with the fixed contact arm 8 to make conduction. Also, the crossbar 1 lifts the auxiliary lever 2 and the auxiliary contact lever 4 is cooperatively lifted to come into contact with the auxiliary contact 5 to operate it.

In the MMR according to the related art, in order to operate the auxiliary contact 5, the auxiliary lever 2 is essential.

However, in the related art, the auxiliary lever 2 is a component serving to lift the auxiliary contact lever 4 to simply operate the auxiliary contact 5, and a function thereof limited.

Thus, the use of the auxiliary lever 2 as a separate component to operate the auxiliary contact 5 degrades assembly characteristics, and also, due to a defect of the auxiliary lever 2 or a defective assembly of the auxiliary lever 2, the auxiliary lever 2 may not normally push up the auxiliary contact lever 4 to cause defective conduction of the auxiliary contact 5.

SUMMARY OF THE INVENTION

Therefore, an aspect of the detailed description is to provide a manual motor starter (MMS) including a crossbar having a function of an auxiliary lever so that an auxiliary contact may be operated only by the crossbar.

To achieve these and other advantages and in accordance with the purpose of this specification, as embodied and broadly described herein, a structure of a crossbar for a manual motor starter (MMS) including a crossbar connected to an operating mechanism and an auxiliary contact lever operating an auxiliary contact, wherein a pressing unit is formed in the crossbar to operate the auxiliary contact lever upwardly.

The crossbar may include a body portion, a leg portion, and an accommodation portion.

The pressing unit may have a first extending portion extending in an upper direction laterally and a second extending portion extending upwardly.

When the crossbar is moved upwardly, the second extending portion may come into contact with the auxiliary contact lever to apply pressure upwardly.

The second extending portion may be formed of an elastic member.

The first extending portion may be formed of an elastic member.

A rib extends in a vertical direction between the first extending portion and the body portion.

A roller may be provided in an upper end portion of the second extending portion.

According to the structure of a crossbar for an MMS according to embodiments of the present disclosure, since the pressing unit is formed in the crossbar so the function of an auxiliary lever is performed by the crossbar, the configuration and operation are simplified and an operational error is reduced. Also, since the auxiliary lever is removed, the number of components is reduced and assembly characteristics and productivity may be enhanced.

Also, the first extending portion or the second extending portion forming the pressing unit are formed of an elastic member, thus reducing a possibility of generation of slip and flexibly coping with an impact.

Also, since the rib is formed between the body portion of the crossbar and the first extending portion, durability may be enhanced.

Meanwhile, since the auxiliary lever is removed, the number of components may be reduced, assembly characteristics and productivity may be enhanced, and defective assembling and defective operation may be reduced.

Further scope of applicability of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, embodiments will be described in detail with reference to the accompanying drawings such that they can be easily practiced by those skilled in the art to which the present invention pertains, and a technical concept and scope of the present invention are not limited thereto.

Figure 1:
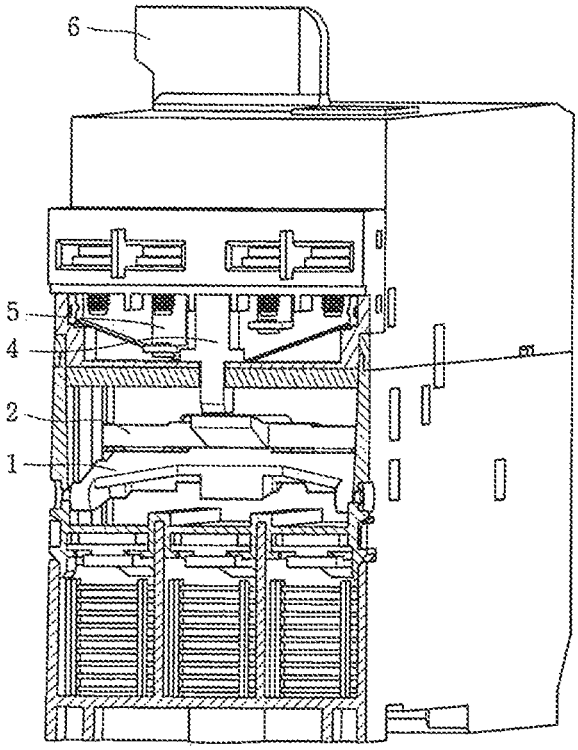
Fig. 1 Prior Art
FIG. 1 is a perspective view of a manual motor starter (MMS) according to a related art.
Figure 2:
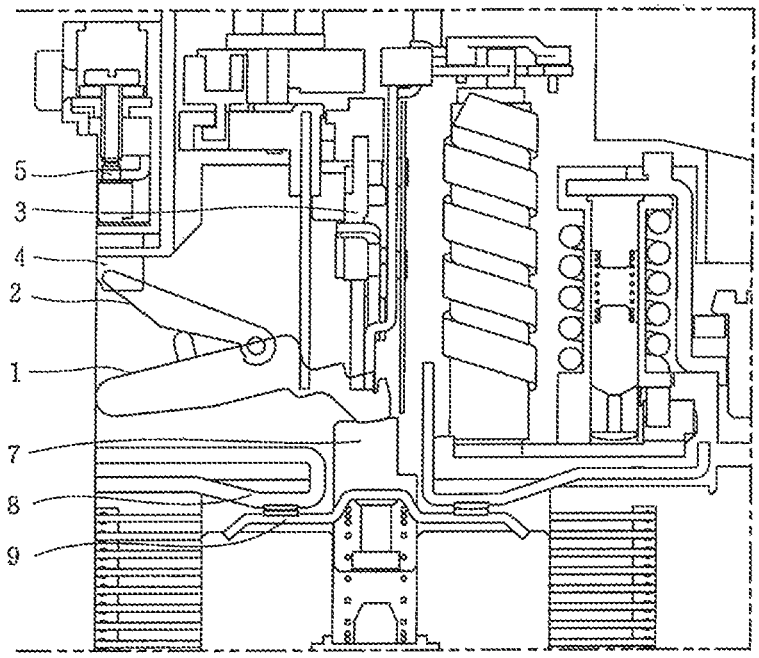
Fig. 2 Prior Art
FIG. 2 is a vertical cross-sectional view illustrating an operational state of the MMR according to the related art in which a handle is in an ON state, viewed in a lateral direction.
Figure 3:
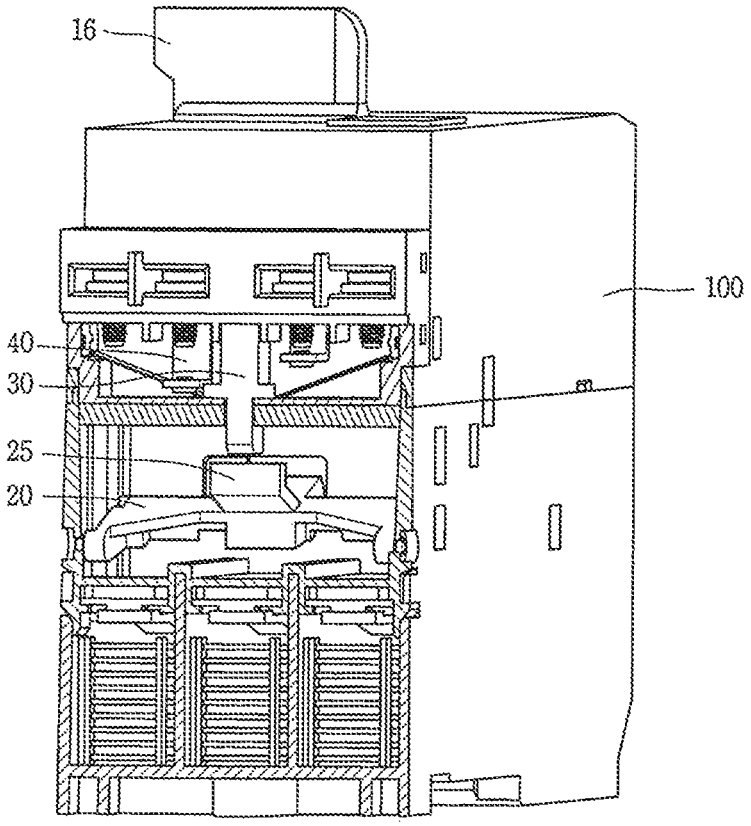
FIG. 3 is a perspective view of an MMR according to an embodiment of the present disclosure.
Figure 4:
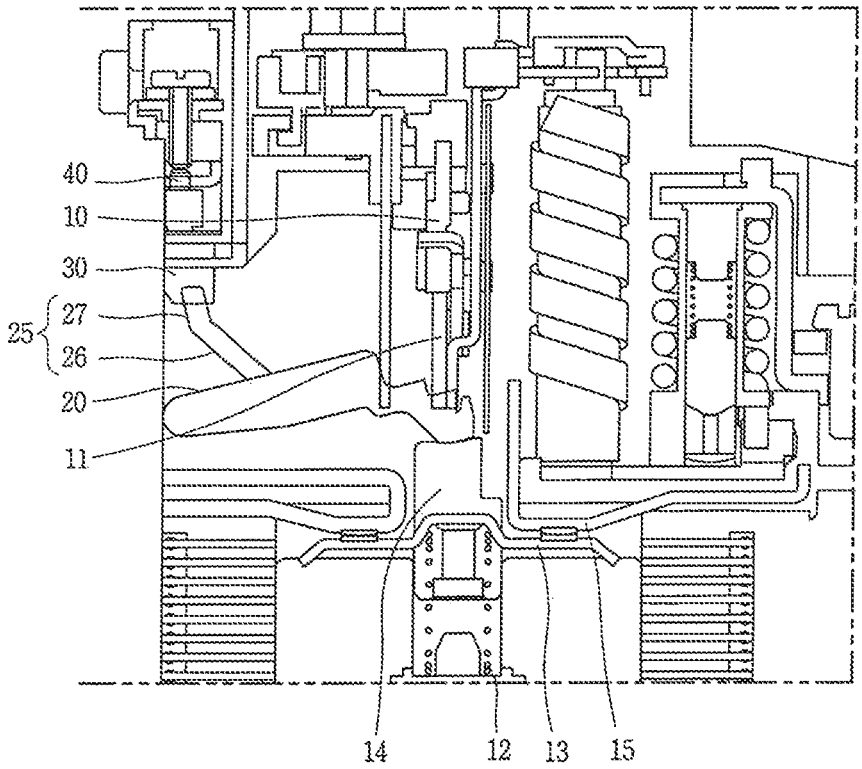
FIG. 4 is a vertical cross-sectional view illustrating an operational state of the MMR according to present disclosure in which a handle is in an ON state, viewed in a lateral direction.
Figure 5:
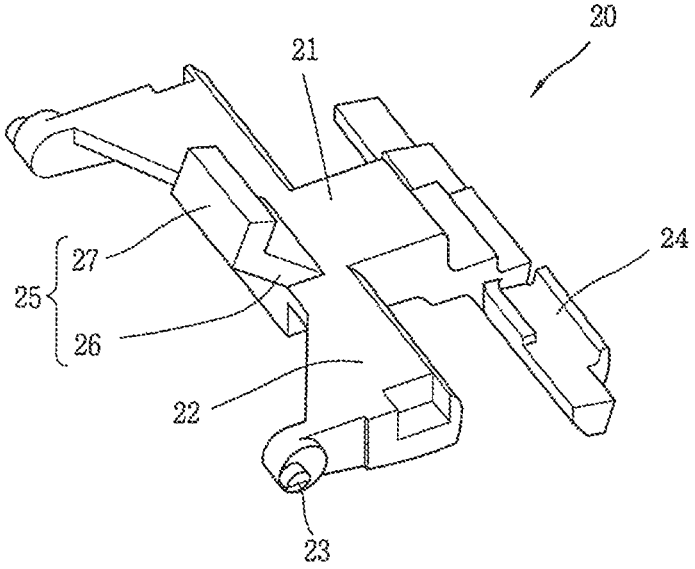
FIG. 5 is a perspective view of a crossbar applied to an MMR according to an embodiment of the present disclosure.

FIG. 3 is a perspective view of a manual motor starter (MMS) according to an embodiment of the present disclosure. FIG. 4 is a vertical cross-sectional view illustrating an operational state of the MMR according to present disclosure in which a handle is in an ON state, viewed in a lateral direction. FIG. 5 is a perspective view of a crossbar applied to an MMR according to an embodiment of the present disclosure. A crossbar structure of a manual motor starter (MMS) according to an embodiment of the present disclosure will be described in detail with reference to the accompanying drawings.

According to an embodiment of the present invention, in a structure of a crossbar for a manual motor starter (MMS) 100 including a crossbar 20 connected to an operating mechanism 10 and an auxiliary contact lever 30 operating an auxiliary contact 40, a pressing unit 25 is formed in the crossbar 20 to operate the auxiliary contact lever 30 upwardly.

First, a basic operation of the MMR will be described with reference to FIG. 4.

For applying a current to a circuit, the operating mechanism 10 is operated according to an operation of a handle 16 to release a push link 11 in a restricted state, and thus, the push link 11 is lifted. Accordingly, a movable contact 13, a connection member 14, and the crossbar 20 interworking with a lower elastic spring 12 are lifted, and the movable contact 13 of a contact unit is brought into contact with a fixed contact 15 to apply a current to the circuit.

Meanwhile, when an overcurrent or a fault current occurs, the operating mechanism 10 operates to restrict the push link 11 to lower push link 11. Accordingly, the crossbar 20, the connection member 14, and the movable contact 13 sequentially connected to the push link 11, resisting a force applied by the elastic spring 12, are lowered downwarly. Thus, the movable contact 13 of the contact unit is separated from the fixed contact 15 and a current is cut off.

A detailed configuration of the crossbar 20 will be described with reference to FIG. 5.

The crossbar 20 includes a body portion 21, a leg portion 22, an accommodation portion 24, and a pressing portion 25.

The leg portion 22 of the crossbar 20 may be formed to extend downwardly from both sides of the body portion 21. A rotational shaft portion 23 may be formed in an end portion of the leg portion 22. In the crossbar 20, the rotational shaft portion 23 may be rotatably installed in a portion of a case of the MMR 100.

The accommodation portion 24 of the crossbar 20 may be formed as a recess. The push link 11 may come into contact with the accommodation portion 24 to operate the crossbar 20. The push link 11 may be restricted to the operating mechanism 10 or may be released therefrom. When the push link 11 is released from the operating mechanism 10, the push link 11 is moved upwardly, and when the push link 11 is restricted by the operating mechanism 10, the push link 11 is moved downwardly. The push link 11 may come into contact with the accommodation portion 24 of the crossbar 20 to apply a force to the crossbar 20, and thus, the crossbar 20 is rotated around the rotational shaft portion 23. The crossbar 20 is forced to be oriented upwardly by the elastic spring 12, and thus, when the push link 11 does not work, the accommodation portion 24 is rotated upwardly, and when the crossbar 20 is pressed downwardly by the push link 11, the accommodation portion 24 is rotated downwardly.

The pressing portion 25 protrudes in a lateral upward direction from the body portion 21. The pressing portion 25 has a first extending portion extending in a lateral upward direction and a second extending portion 27 extending upwardly from the first extending portion 26. The first extending portion 26 is formed to be sloped and serve to extend from the body portion 21 of the crossbar 20 to a lower portion of the auxiliary contact lever 30, and the second extending portion 27 formed vertically to press a lower portion of the auxiliary contact lever 30.

When the crossbar 20 rotatably moves upwardly, the second extending portion 27 applies a force to the auxiliary contact lever 30 to move the auxiliary contact lever 30 upwardly. As the auxiliary contact lever 30 is moved upwardly, the auxiliary contact 40 is conducted.

Conversely, when the crossbar 20 rotatably moves downwardly, the force apply to the auxiliary contact lever 30 by the second extending portion 27 is removed, and thus, the auxiliary contact lever 30 is moved downwardly. As the auxiliary contact lever 30 is moved downwardly, a current flowing to the auxiliary contact 40 is cut off.

According to the structure of the crossbar of the MMR according to an embodiment of the present disclosure, a component of an auxiliary lever used in the related art is removed and the crossbar performs the function of the auxiliary lever. That is, since the function of the auxiliary lever is performed by the crossbar, the configuration and operation are simplified and an operational error is reduced. Also, since the auxiliary lever is removed, the number of components is reduced and assembly characteristics and productivity may be enhanced.

Figure 6:
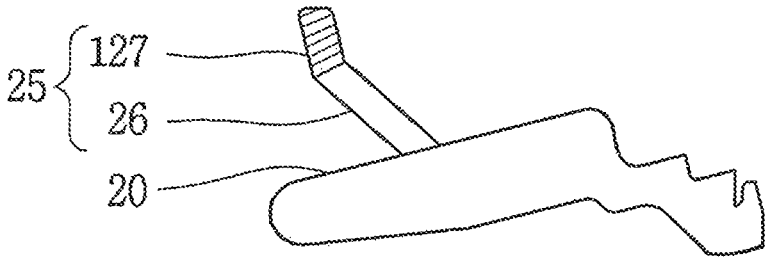
FIG. 6 is a side view of a crossbar applied to an MMR according to another embodiment of the present disclosure.

A crossbar applied to an MMR according to another embodiment of the present disclosure will be described with reference to FIG. 6.

In this embodiment, the second extending portion 127 may be formed as an elastic member. Since the second extending portion 127 is formed as an elastic member, when the second extending portion 127 comes into contact with the auxiliary contact lever 30, contact force is enhanced and the second extending portion 127 does not slide, reducing a possibility of a defective operation. The elastic member may be formed of rubber or a flexible material. Also, although not shown, the elastic member may include a spring.

Figure 7:
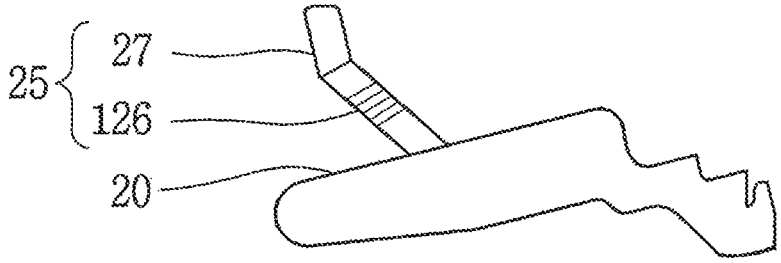
FIG. 7 is a side view of a crossbar applied to an MMR according to another embodiment of the present disclosure.

A crossbar applied to an MMR according to another embodiment of the present disclosure will be described with reference to FIG. 7.

In this embodiment, a portion of the first extending portion 126 may be formed as an elastic member. Since the first extending portion 126 is elastically deformed between the body portion 21 and the second extending portion 27, an impact that occurs between the auxiliary contact lever 30 and the second extending portion 27 may be flexibly handled, preventing damage to the crossbar 20.

Figure 8:
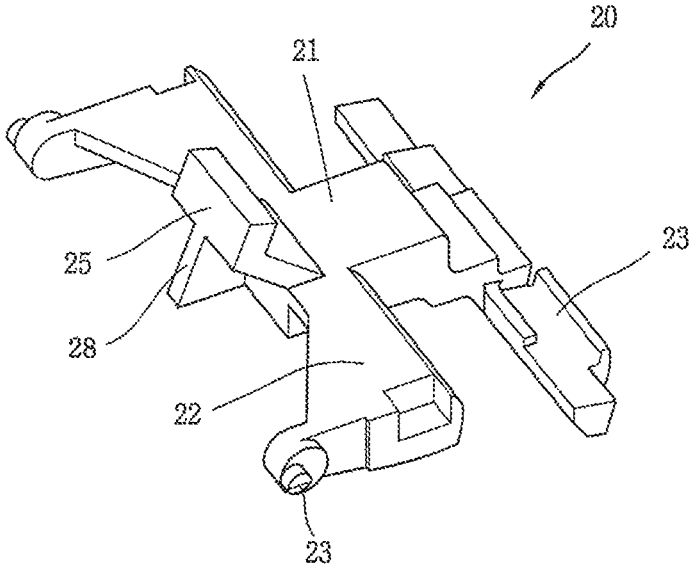
FIG. 8 is a side view of a crossbar applied to an MMR according to another embodiment of the present disclosure.

A crossbar applied to an MMR according to another embodiment of the present disclosure will be described with reference to FIG. 8.

In this embodiment, a vertical rib 28 may extend between the first extending portion 26 and the body portion 21. The crossbar 20 is repeatedly used for a long period of time, and thus, a weak portion thereof may be easily damaged. In consideration of this, the vertically formed rib 28 is provided between the first extending portion 26 and the body portion 21 to reinforce the configuration, thus enhancing durability.

Figure 9:
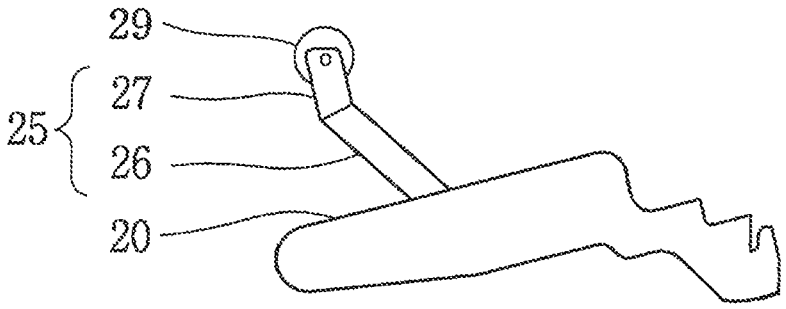
FIG. 9 is a side view of a crossbar applied to an MMR according to another embodiment of the present disclosure.

A crossbar applied to an MMR according to another embodiment of the present disclosure will be described with reference to FIG. 9.

In this embodiment, a roller 29 may be provided at an upper end portion of the second extending portion 27. Since the roller 29 is provided at the upper end portion of the second extending portion 27, when the second extending portion 27 comes into contact with the auxiliary contact lever 30, it may elastically contact with the auxiliary contact lever 30. Also, even though the second extending portion 27 is shaken horizontally, the second extending portion 27 may be flexibly contact the auxiliary contact lever through rolling of the roller 29. Here, the roller 29 may be formed of an elastic member.

According to the structure of a crossbar for an MMS according to embodiments of the present disclosure, since the pressing unit is formed in the crossbar so the function of an auxiliary lever is performed by the crossbar, the configuration and operation are simplified and an operational error is reduced. Also, since the auxiliary lever is removed, the number of components is reduced and assembly characteristics and productivity may be enhanced.

Also, the first extending portion or the second extending portion forming the pressing unit are formed of an elastic member, thus reducing a possibility of generation of slip and flexibly coping with an impact.

Also, since the rib is formed between the body portion of the crossbar and the first extending portion, durability may be enhanced.

Meanwhile, since the auxiliary lever is removed, the number of components may be reduced, assembly characteristics and productivity may be enhanced, and defective assembling and defective operation may be reduced.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A structure of a crossbar for a manual motor starter (MMS), the crossbar connected to an operating mechanism and an auxiliary contact lever operating an auxiliary contact, the structure of the crossbar comprising:

a body portion, a leg portion extending downward from both sides of the body portion, the leg portion including a rotational shaft portion formed in an end portion of the leg portion; and a pressing portion protruding in a lateral upward direction from the body portion, the pressing portion including a first extending portion extending in a lateral upward direction from the body portion and a second extending portion extending vertically upward from the first extending portion, wherein the crossbar rotates about the rotational shaft portion, wherein the first extending portion is sloped and extends to a lower portion of the auxiliary contact lever, and wherein the second extending portion presses the lower portion of the auxiliary contact lever when the crossbar is moved upward.

2. The structure of a crossbar of claim 1 wherein the second extending portion is formed of an elastic member.

3. The structure of a crossbar of claim 1, wherein the first extending portion is formed of an elastic member.

4. The structure of a crossbar of claim 1, further comprising a rib extending in a vertical direction between the first extending portion and the body portion.

5. The structure of a crossbar of claim 1, wherein an upper end portion of the second extending portion includes a roller.

* * * * *